US007917967B2

(12) United States Patent
Osborne

(10) Patent No.: US 7,917,967 B2
(45) Date of Patent: Apr. 5, 2011

(54) FRONT BREAK AWAY BALLISTICS VEST

(75) Inventor: Kurt J. Osborne, Charlotte, NC (US)

(73) Assignee: Survival Armor, Inc., Fort Myers, FL (US)

( * ) Notice: Subject to any disclaimer, the term of this patent is extended or adjusted under 35 U.S.C. 154(b) by 933 days.

(21) Appl. No.: 11/745,491

(22) Filed: May 8, 2007

(65) Prior Publication Data

US 2010/0223705 A1 Sep. 9, 2010

(51) Int. Cl.
*F41H 1/04* (2006.01)

(52) U.S. Cl. ..... 2/2.5; 428/911

(58) Field of Classification Search ..... 2/2.5
See application file for complete search history.

(56) References Cited

U.S. PATENT DOCUMENTS

| | | | | | |
|---|---|---|---|---|---|
| 2,052,684 | A | * | 9/1936 | Wlsbrod | 2/2.5 |
| 2,748,391 | A | * | 6/1956 | Lewis, Jr. et al. | 2/2.5 |
| 3,337,875 | A | * | 8/1967 | Blakeney | 2/2.5 |
| 3,452,362 | A | * | 7/1969 | Korolick et al. | 2/2.5 |
| 3,634,889 | A | * | 1/1972 | Rolsten | 2/2.5 |
| 3,793,648 | A | * | 2/1974 | Dorre et al. | 2/2.5 |
| 3,873,998 | A | * | 4/1975 | Norris et al. | 2/2.5 |
| 4,483,020 | A | * | 11/1984 | Dunn | 2/2.5 |
| 4,535,478 | A | * | 8/1985 | Zufle | 2/2.5 |
| H7 | H | | 1/1986 | Martone | |
| 4,633,756 | A | * | 1/1987 | Rudoi | 89/36.02 |
| 5,044,011 | A | * | 9/1991 | Henderson | 2/2.5 |
| 5,060,314 | A | | 10/1991 | Lewis | |
| 5,072,453 | A | * | 12/1991 | Widder | 2/2.5 |
| 5,966,747 | A | | 10/1999 | Crupi et al. | |
| D429,384 | S | | 8/2000 | Crupi et al. | |
| 6,769,137 | B2 | | 8/2004 | D'Annunzio | |
| 6,948,188 | B2 | | 9/2005 | D'Annunzio | |
| 7,020,897 | B2 | | 4/2006 | Johnson | |
| 7,047,570 | B2 | * | 5/2006 | Johnson | 2/102 |
| 7,266,850 | B1 | * | 9/2007 | Strum et al. | 2/2.5 |
| 2002/0120973 | A1 | * | 9/2002 | D'Annunzio | 2/92 |
| 2003/0037812 | A1 | * | 2/2003 | Stewart et al. | 135/96 |
| 2004/0221361 | A1 | * | 11/2004 | D'Annunzio | 2/69 |
| 2005/0005342 | A1 | * | 1/2005 | Johnson | 2/102 |
| 2005/0005343 | A1 | * | 1/2005 | Johnson | 2/102 |
| 2007/0107109 | A1 | * | 5/2007 | Johnson | 2/102 |
| 2008/0098500 | A1 | * | 5/2008 | Matic et al. | 2/2.5 |
| 2008/0235841 | A1 | * | 10/2008 | McDunn et al. | 2/2.5 |
| 2008/0295210 | A1 | * | 12/2008 | Matic et al. | 2/2.5 |

* cited by examiner

*Primary Examiner* — Bobby H Muromoto, Jr.
(74) *Attorney, Agent, or Firm* — The Livingston Firm; Edward M. Livingston, Esq.; Bryan L. Loeffler, Esq.

(57) ABSTRACT

A front break away ballistics vest (1) having a front (36) and a back section (11) that are securable to one another. The front section (36) has an upper front section (18) and a lower front (12) section. A first clip (38) is located on the upper front section (18) to release a first shoulder strap (4) from the first clip (38) and a second clip (39) is located on the upper front section (18) to release a second shoulder strap (5) from the second clip (39). The first and second clips (38 and 39) are secured to one another, preferably via a release strap (44). A third clip (40) is located on the lower front section (12) to release the first and second clips (38 and 39) from the third clip (40). The third clip (40) is also secured to the first and second clips (38 and 39), preferably via the release strap (44).

14 Claims, 3 Drawing Sheets

FRONT BREAK AWAY BALLISTICS VEST

BACKGROUND OF THE INVENTION

This invention relates to ballistics vests, more particularly, a front break away ballistics vest that permits a user to quickly and easily remove the ballistics vest with one hand.

Currently, ballistics vests, which are also referred to as bullet-proof vests or armored vests, comprise three main components: a ballistics vest pad having body-face side and an opposing strike-face side, a non-removable cover (which is also referred to as a pad cover) and a carrier. When a person desires to use the armored vest, he or she inserts the covered ballistics vest pad into the carrier. Then, if the carrier is in the form of a jacket, a first arm is inserted into a first armhole and a second arm is inserted into a second armhole. If the carrier is in the form of an over-the-head type carrier, the person places his/her arms through the armholes and head through the head hole in order to wear the carrier. The carrier is then worn underneath or over the person's clothing. Therefore, in order to remove the ballistics vest, the user must first take off the carrier, a process which is very time-consuming.

In the event the user of the ballistics vest is in an emergency situation requiring quick removal of the ballistics vest, for example, if the user is in water and the weight of the vest is too great, time is of the essence to the user of the vest in dire need to remove the vest.

In addition, the user may not always have the luxury of being able to use both arms or both hands for the removal of the ballistics vest, a situation that commonly occurs when the user is injured or otherwise occupied with another task.

Thus, a need exists for a ballistics vest that permits a user to quickly and easily remove the ballistics vest with one hand.

The relevant prior art includes the following references:

| patent No. (U.S. unless stated otherwise) | Inventor | Issue/Publication Date |
|---|---|---|
| 2005/0005342 | Johnson | Jan. 13, 2005 |
| 7,047,570 | Johnson | May 23, 2006 |
| 2005/0005343 | Johnson | Jan. 13, 2005 |
| 7,020,897 | Johnson | Apr. 4, 2006 |
| 6,948,188 | D'Annunzio | Sep. 27, 2005 |
| H7 | Martone | Jan. 07, 1986 |
| 5,966,747 | Crupi et al. | Oct. 19, 1999 |
| Des. 429,384 | Crupi et al. | Aug. 8, 2000 |
| 5,060,314 | Lewis | Oct. 29, 1991 |
| 6,769,137 | D'Annunzio | Aug. 3, 2004 |

SUMMARY OF THE INVENTION

The primary object of the present invention is to provide a front break away ballistics vest that permits a user to quickly remove the ballistics vest.

A further object of the present invention is to provide a front break away ballistics vest that permits a user to easily remove the ballistics vest.

An even further object of the present invention is to provide a front break away ballistics vest that permits a user to remove the ballistics vest with one hand.

The present invention fulfills the above and other objects by providing a front break away ballistics vest having a front section and aback section that are securable to one another. The front section has a first side front section and a second side front section while the back section has a first side back section and a second side back section. The front section also has an upper front section and a lower front section. A first shoulder strap and a second shoulder strap are connected to said back section and extend toward the upper front section. A first release means, which is preferably a first clip, is located on the upper front section to release the first shoulder strap from the first release means and a second release means, which is preferably a second clip, is located on the upper front section to release the second shoulder strap from the second release means. The first and second release means are secured to one another, preferably via a release strap. A third release means, which is preferably a third clip, is located on the front lower section to release the first and second side straps from the third release means. The third release means is also secured to the first and second release means, preferably via the release strap. For ease of use, a release strap handle is located on the release strap. An upper flap preferably covers the upper front section while a lower flap preferably covers the front lower section.

To release the ballistics vest of the present invention from a user, the user lifts the upper flap so as to gain access to the release strap handle. Then, he/she pulls the release strap handle in an outward direction so as to unsecure the release means (unclasping the clips), thereby permitting the first and second shoulder straps to disconnect from the first and second release means and permitting the first and second side straps to disconnect from the third release means.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
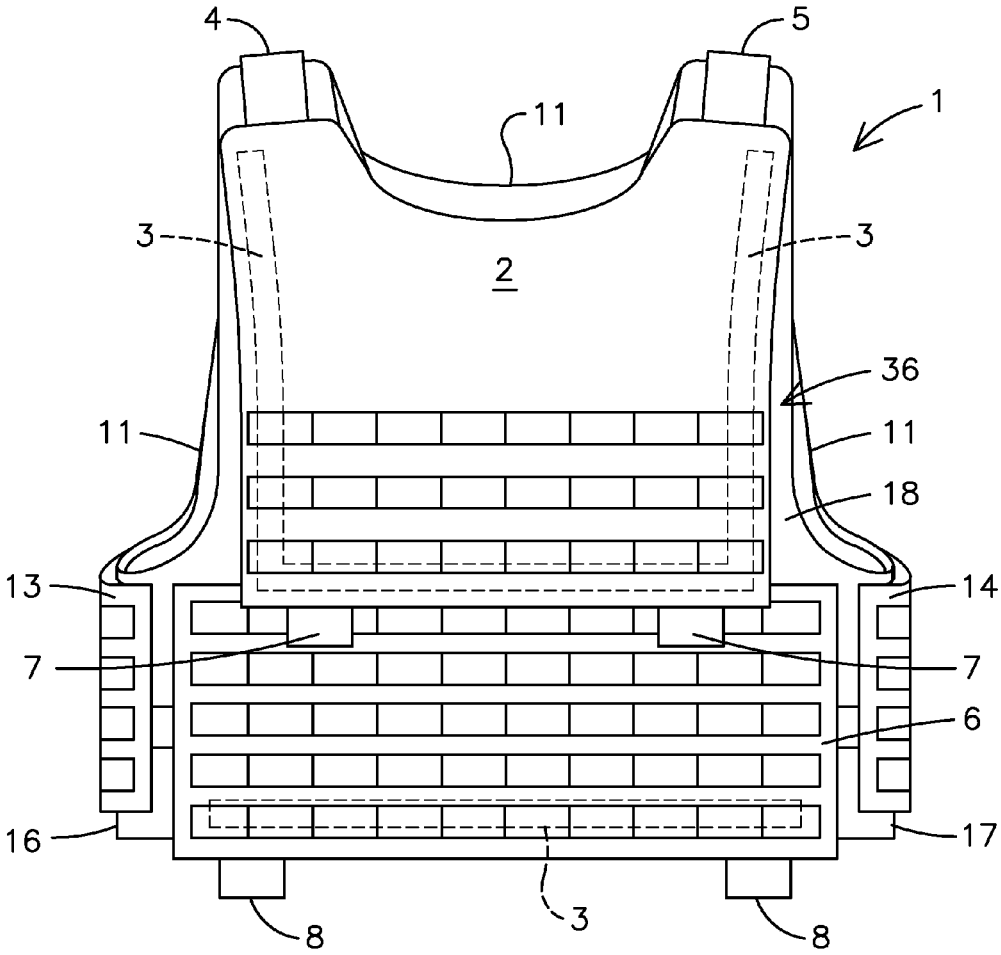
FIG. 1 is a front plan view of a front break away ballistics vest of the present invention.

For purposes of describing the preferred embodiment, the terminology used in reference to the numbered components in the drawings is as follows:

1. front break away ballistics vest, generally
2. upper flap
3. flap fastening means
4. first shoulder strap -continued 5. second shoulder strap
6. lower flap
7. upper flap tab
8. lower flap tab
9. first side strap
10. second side strap
11. back section
12. front lower section
13. first side back section
14. second side back section
15. vest handle
16. first side front section
17. second side front section
18. upper front section
19. shoulder strap retaining means
20. ring
21. clip, generally
22. clip retaining means
23. pin pull
24. horizontal release strap
25. release strap handle
26. vertical release strap
27. buckle
28. front section fastening means
29. clip ring
30. pin
31. clip first section
32. clip second section
33. joint
34. shoulder strap tab
35. shoulder strap adjustment means
36. front section
37. aperture
38. first clip
39. second clip
40. third clip
41. first release means
42. second release means
43. third release means
44. release strap, generally
45. single-handed release system, generally
46. shoulder strap fastening means With reference to FIG. 1, a front plan view of a front break away ballistics vest of the present invention is shown. The front break away ballistics vest, generally 1, includes a front section 36 and a back section 11 joined together via a first shoulder strap 4 and a second shoulder strap 5. The front section 36 includes a first side front section 16 and a second side front section 17 while the back section 11 includes a first side back section 13 and a second side back section 14. In this manner, the first side front section 16 is securable to the first side back section 13 and the second side front section 17 is securable to the second side back section 14 so as to wrap around and protect the sides of a user of the front break away ballistics vest 1. An upper flap 2 and a lower flap 6 are located on an upper portion of the front section 36 of the front break away ballistics vest 1. The flaps 2 and 6 are secured to the front section 36 such that a user may lift the flaps 2 and 6 to expose the upper front section 18 and lower front section 12 (shown in FIG. 4) of the vest 1. For ease of use, the upper flap 2 preferably includes at least one upper flap tab 7 and the lower flap 6 preferably includes at least one lower flap tab 8 to permit a user to grasp the tabs 7 and 8 to raise the flaps 2 and 6. Flap fastening means 3 are preferably located on an underside of the flaps 2 and 6 so as to retain the flaps 2 and 6 against the upper front section 18 and lower front section 12.

Figure 2:
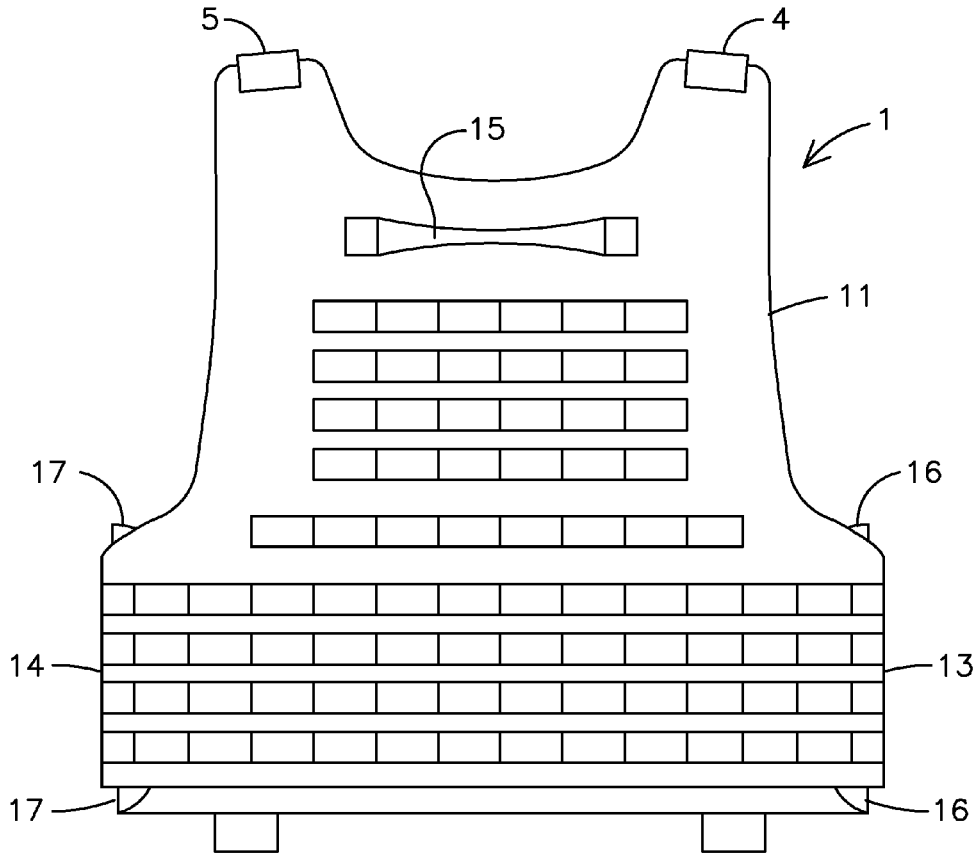
FIG. 2 is a rear view of a front break away ballistics vest of the present invention.

In FIG. 2, a rear view of a front break away ballistics vest of the present invention is shown. The back section 11 of the front break away ballistics vest 1 preferably includes a vest handle 15 to permit a user to easily carry and store the vest 1. The first side back section 13 and the second side back section 14 preferably extend around the sides of a user and overlap the first side front section 16 and second side front section 17, respectively. In addition, the first shoulder strap 4 and the second shoulder strap 5 are preferably secured to the back section 11 of the front break away ballistics vest 1 so as to allow the vest 1 to hang over the shoulders of a user.

Figure 3:
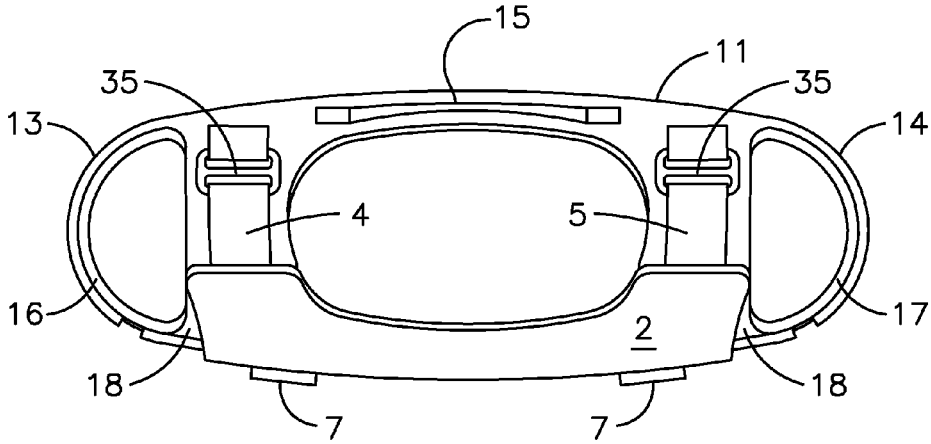
FIG. 3 is a top view of a front break away ballistics vest of the present invention.

With reference to FIG. 3, a top view of a front break away ballistics vest of the present invention is shown. The first shoulder strap 4 and second shoulder strap 5 are preferably adjustable via a shoulder strap adjustment means 35 so as to provide a tailored fit for the user. The shoulder straps 4 and 5 preferably are located between the upper flap 2 and the upper front section 18.

Figure 4:
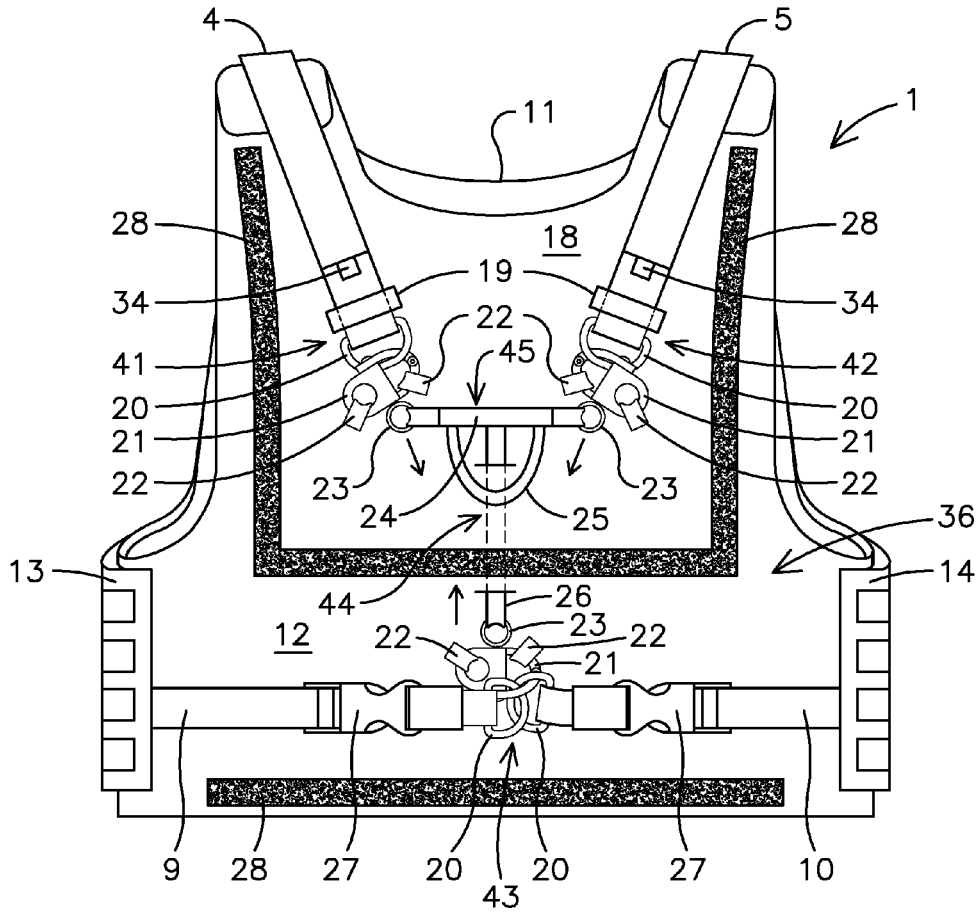
FIG. 4 is a front plan view of a front break away ballistics vest of the present invention without an upper flap and lower flap.

Next, FIG. 4 shows a front plan view of a front break away ballistics vest of the present invention without the upper flap and lower flap of FIG. 1 so as to show components of the release system. The front break away ballistics vest 1 of the present invention includes a single-handed release system, generally 45 to permit a user to quickly and easily remove the vest 1 with one hand. The single-handed release system 45 includes a first release means 41, a second release means 42 and a third release means 43 joined together via a release strap 44. The first and second release means 41 and 42 are located on the upper front section 18 while the third release means 43 is located on the lower front section 12. The release means 41, 42 and 43 are preferably clips 21 that are able to be opened, which are shown in greater detail in FIG. 5. Each clip 21 is secured to the ballistics vest 1, preferably via a clip retaining means 22, so as to retain the clips 21 on the vest 1, even when the clips 21 are opened. Each clip 21 also includes a pin pull 23 which permits the clip 21 to open when the pin pull 23 is pulled.

Each shoulder strap 4 and 5 includes a shoulder strap tab 34 to permit a user to easily grasp the shoulder strap 4 and 5 for readjustment. When the proper length is determined, each shoulder strap 4 and 5 is fed through a shoulder strap retaining means 19 located on the upper front section 18. A ring 20, which is preferably a D-ring, is secured at a bottom of each shoulder strap 4 and 5.

Similarly, a first side strap 9 and a second side strap 10 are provided for permitting a customized fit of the vest 1 around the torso of a user. Secured to the first side back section 13 and second side back section 14, respectively and preferably include a buckle 27 for adjustment purposes. Located at the end of each side strap 9 and 10 is a ring 20.

Each ring 20 is secured within a clip 21 for maintaining the shoulder straps 4 and 5 and side straps 9 and 10 in connection with the single-handed release system 45. Each pin pull 23 is secured to a release strap, generally 44. The release strap 44 preferably includes a horizontal release strap 24 wherein the pin pulls 23 for the shoulder straps 4 and 5 are connected and a vertical release strap 26 wherein the pin pull 23 for the side straps 9 and 10 are connected. A release strap handle 25 is preferably provided to permit a user to remove the pin pulls 23 from the clips 21 attached to the shoulder straps 4 and 5 and attached to the side straps 9 and 10 with one pull. When the release strap handle 25 is pulled, the pin pulls 23 for the clips 21 attached to the shoulder straps 4 and 5 move in a downward manner while the pin pull 23 for the clips 21 attached to the side straps 9 and 10 is moved in an upward manner. When the pin pulls 23 are released from the clips 21, the shoulder straps 4 and 5 and side straps 9 and 10 are released, the front section 36 is no longer connected to the back section 11, thereby allowing the vest 1 to fall off of the user.

At least one front section fastening means 28, which corresponds to the flap fastening means 3 and is preferably located on the front section 36 of the vest 1, retains the upper flap 2 and lower flap 6 on the front section 36.

Figure 5:
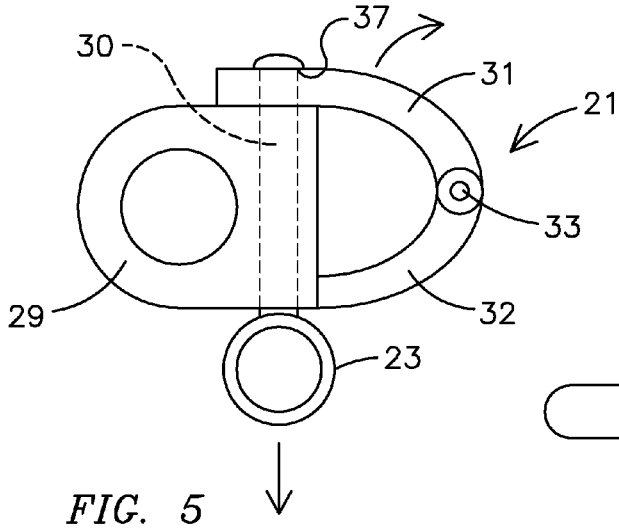
FIG. 5 is a side view of a clip used in conjunction with a front break away ballistics vest of the present invention.
Figure 6:
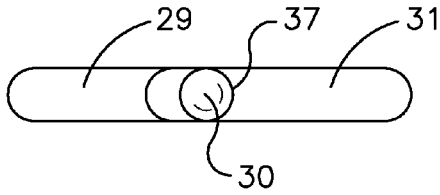
FIG. 6 is a top view of the embodiment of FIG. 5.

In FIGS. 5 and 6, varying views of a clip used in conjunction with a front break away ballistics vest of the present invention is shown. The clip 21 includes a clip ring 29, a clip first section 31, a clip second section 32 and a pin 30 having a pin pull 23 attached thereto. The clip first section 31 is pivotally connected to the clip second section 32 along a joint 33. The pin 30 extends through the clip ring 29 and is inserted into an aperture 37 on the clip first section 31. When the pin pull 23 is pulled, the pin 30 is removed from the aperture 37, thereby permitting the clip first section 31 to open.

Figure 7:
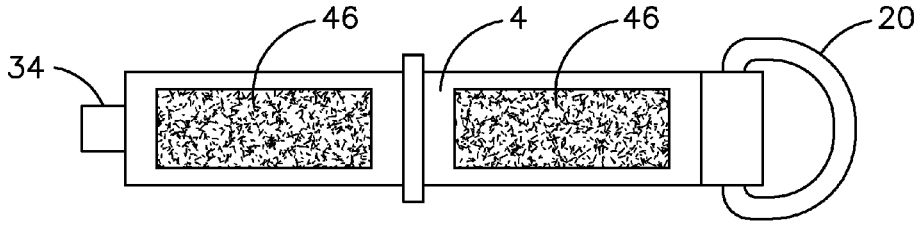
FIG. 7 is a front view of an open shoulder strap of a front break away ballistics vest of the present invention.

Next, FIG. 7 shows a front view of an open shoulder strap of a front break away ballistics vest of the present invention, the shoulder strap 4 or 5 preferably includes a shoulder strap fastening means 46 located on an interior of the shoulder strap 4 or 5. A ring 20 is located at a bottom of the shoulder strap 4 or 5 for securement within a clip 21.

Figure 8:
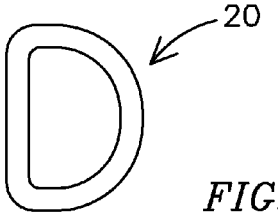
FIG. 8 is a side view of a ring of a break away ballistics vest of the present invention.

Finally, FIG. 8 shows a side view of a ring of a break away ballistics vest of the present invention. The ring 20 is preferably in the shape of a D-ring, although other shapes may also be used.

The use of the present invention will permit a user to quickly and easily remove the front break away ballistics vest 1 with one hand.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

Having thus described my invention, I claim:

1. A front break away ballistics vest comprising:

a front section and a back section wherein said front section is securable to said back section;

said front section having a first side front section and a second side front section;

said front section having an upper front section and a lower front section;

said lower front section having a first side front section and a second side front section;

said back section having a first side back section and a second side back section;

a first shoulder strap connected to said back section;

a second shoulder strap connected to said back section;

at least one clip located on the front section;

said at least one clip having a first section pivotally attached to the at least one clip for opening and closing said at least one clip and a pin extending through an aperture located in the clip and the first section of the clip for locking the first section in a closed position;

said first shoulder strap is removably attached to the at least one clip;

said second shoulder strap is removably attached to the at least one clip; and a release strap attached to the pin of the at least one clip for disengaging the pin from the first section, thereby opening the at least one clip and releasing the first shoulder strap and the second shoulder strap from the at least one clip.

2. The rear break away ballistics vest of claim 1 further comprising:

a first side strap secured to said back section; and said first side strap is removably attachable to the at least one clip.

3. The rear break away ballistics vest of claim 1 further comprising:

a second side strap secured to said back section; and said second side strap is removably attachable to the at least one clip.

4. The rear break away ballistics vest of claim 1 further comprising:

a flap partially removably secured to said front section.

5. The rear break away ballistics vest of claim 1 further comprising:

a flap partially removably secured to said back section.

6. The rear break away ballistics vest of claim 1 further comprising:

a release strap handle connected to said release strap.

7. A rear break away ballistics vest comprising:

a front section and a back section wherein said front section is securable to said back section;

said front section having a first side front section and a second side front section;

said front section having an upper front section;

said back section having a first side back section and a second side back section;

said back section having a back section cover secured to said back section;

a first shoulder strap connected to said back section and extending to said front section;

a second shoulder strap connected to said back section and extending to said front section;

at least one clip located on the front section;

said at least one clip having a first section pivotally attached to the at least one clip for opening and closing said at least one clip and a pin extending through an aperture located in the clip and the first section of the clip for locking the first section in a closed position;

said first shoulder strap is removably attached to the at least one clip;

said second shoulder strap is removably attached to the at least one clip;

a first side strap secured to said back section;

said first side strap is removably attachable to the at least one clip;

a second side strap secured to said back section;

said second side strap is removably attachable to the at least one clip; and a release strap attached to the pin of the at least one clip for disengaging the pin from the first section, thereby opening the at least one clip and releasing the first shoulder strap, the second shoulder strap, the first side strap and the second side strap from the at least one clip.

8. The rear break away ballistics vest of claim 7 further comprising:

a flap partially removably secured to said front section.

9. The rear break away ballistics vest of claim 7 further comprising:

a flap partially removably secured to said back section.

10. The rear break away ballistics vest of claim 7 further comprising:

a release strap handle connected to said release strap.

11. A rear break away ballistics vest comprising:

a front section and a back section wherein said front section is securable to said back section;

said front section having a first side front section and a second side front section;

said front section having an upper front section;

said back section having a first side back section and a second side back section;

said back section having a back section cover secured to said back section;

a first shoulder strap connected to said back section and extending to said front section;

a second shoulder strap connected to said back section and extending to said front section;

at least one clip located on the front section;

said at least one clip having a first section pivotally attached to the at least one clip for opening and closing said at least one clip and a pin extending through an aperture located in the clip and the first section of the clip for locking the first section in a closed position;

said first shoulder strap is removably attachable to the at least one clip via a ring;

said second shoulder strap is removably attachable to the at least one clip via a ring;

a first side strap secured to said back section;

said first side strap is removably attached to the at least one clip via a ring;

a second side strap secured to said front section;

said second side strap is removably attached to the at least one clip via a ring; and a release strap attached to the pin of the at least one clip for disengaging the pin from the first section, thereby opening the at least one clip and releasing the ring of the first shoulder strap, the ring of the second shoulder strap, the ring of the first side strap and the ring of the second side strap from the at least one clip.

12. The rear break away ballistics vest of claim 11 further comprising:

a flap partially removably secured to said front section.

13. The rear break away ballistics vest of claim 11 further comprising:

a flap partially removably secured to said back section.

14. The rear break away ballistics vest of claim 11 further comprising:

a release strap handle connected to said release strap.

* * * * *